US012742552B2

(12) United States Patent
Berg et al.

(10) Patent No.: US 12,742,552 B2
(45) Date of Patent: Sep. 22, 2026

(54) BRICK INSTALLATION KIT, AND ASSOCIATED METHODS OF ASSEMBLY AND FIREPLACE SYSTEMS

(71) Applicant: HNI Technologies Inc., Muscatine, IA (US)

(72) Inventors: Richard Berg, Lakeville, MN (US); Gary Butler, Lakeville, MN (US); Wayne Kuechenmeister, Lakeville, MN (US)

(73) Assignee: HNI Technologies Inc., Muscatine, IA (US)

( * ) Notice: Subject to any disclaimer, the term of this patent is extended or adjusted under 35 U.S.C. 154(b) by 379 days.

(21) Appl. No.: 18/427,107

(22) Filed: Jan. 30, 2024

(65) Prior Publication Data

US 2024/0255150 A1 Aug. 1, 2024

Related U.S. Application Data

(60) Provisional application No. 63/442,003, filed on Jan. 30, 2023.

(51) Int. Cl.

| | |
|---|---|
| ***F24B 1/18*** | (2006.01) |
| ***F24B 1/195*** | (2006.01) |
| ***F24C 3/00*** | (2006.01) |

(52) U.S. Cl.

CPC ..... *F24B 1/1808* (2013.01); *F24B 1/195* (2013.01); *F24C 3/002* (2013.01)

(58) Field of Classification Search

CPC ..... F24B 1/1808; F24B 1/195; F24C 3/002

See application file for complete search history.

(56) References Cited

U.S. PATENT DOCUMENTS

| | | | | |
|---|---|---|---|---|
| 6,098,364 A * | 8/2000 | Liu | E04F 13/0855 | 52/235 |
| 6,170,214 B1 * | 1/2001 | Treister | E04F 13/0808 | 52/235 |
| 2008/0216444 A1 * | 9/2008 | Loyd | E04F 13/0826 | 52/742.16 |
| 2018/0135309 A1 * | 5/2018 | Mann | E04F 13/0873 | |
| 2021/0285647 A1 * | 9/2021 | Prior | F24B 1/195 | |

FOREIGN PATENT DOCUMENTS

| | | | |
|---|---|---|---|
| CA | 3064111 A1 * | 6/2020 | E04B 2/22 |

* cited by examiner

*Primary Examiner* — Ngoc T Nguyen

(74) *Attorney, Agent, or Firm* — Faegre Drinker Biddle & Reath LLP

(57) ABSTRACT

Brick installation kits including a plurality of retention brackets, including a first retention bracket including a plurality retention slots, a plurality of retention clips, each retention clip having a head and a foot receivable in a corresponding one of the plurality of retention slots, and a plurality of brick panels, each brick panel having a first edge, a second edge opposite the first edge a first retention groove running along the first edge and a second retention groove running along the second edge. The first retention groove is configured to receive the foot of a corresponding one of the plurality of retention clips and the second retention groove is configured to receive a head of a corresponding one of the plurality of retention clips.

15 Claims, 7 Drawing Sheets

BRICK INSTALLATION KIT, AND ASSOCIATED METHODS OF ASSEMBLY AND FIREPLACE SYSTEMS

CROSS-REFERENCE TO RELATED PATENT APPLICATIONS

This application claims priority to and the benefit of U.S. Provisional Application No. 63/442,003, filed on Jan. 30, 2023, the disclosures of which are hereby incorporated herein by reference in their entirety.

BACKGROUND

Gas and other fireplaces manufactured for installation in residences and commercial buildings typically have a metal firebox in which combustion occurs. These fireplaces often have refractory panels that are installed inside the firebox of the fireplace, or firebrick installed with a refractory cement and mortar between individual firebricks. Refractory panels and firebrick serve to act as insulators for limiting heat transfer into the metal sides of the firebox. Refractory panels may be made of precast fiber-reinforced concrete panels that are specifically tailored to for use with a firebox of a particular size and shape.

SUMMARY

This specification addresses various improvements and advantages over traditional refractory panel and firebrick installations. By way of example, and without limitation, various aspects of the designs and methods provided herewith address reduced installation time, ease of customization, enhanced durability, preferable aesthetic design, and others.

Some designs provided herewith relate to a brick installation kit including a plurality of retention brackets, a plurality of retention clips, and a plurality of brick panels. The kit is generally configured to be installed in a firebox of a fireplace. However, though described as being used in a firebox of a fireplace, it should be understood other applications of the brick installation kit (e.g., in outdoor firepits or as part of a protective or decorative covering) are also contemplated.

In various examples, the retention brackets are configured to be installed in a firebox of a fireplace and secured thereto (e.g., using fasteners, adhesives, or the like). The retention brackets are generally configured to run laterally, or side-to-side, across the back and/or the sides of the firebox. The plurality of retention brackets each include a plurality of clip apertures. Although horizontal installations—i.e., side-to-side—are described by way of example, in other implementations the retention brackets may be configured to run vertically. The retention brackets may include one or more base brackets, or starter brackets, with a retention edge.

The plurality of retention clips may be individual components, or supplied as part of one or more clip strips, each strip including a plurality of retention clips. The retention clips are each configured to be extended through one or more of the clip apertures.

In various examples, the plurality of brick panels are made of insulative material, such as firebrick or refractory brick material. The plurality of brick panels may be cut to a desired shape and size, may include a variety of colors and textures, or otherwise be varied for aesthetic appeal, fit, and/or performance. Principal raw materials for firebrick include cements, fiber reinforced cements; fireclays, such as hydrated aluminum silicates; minerals of high aluminum oxide content, such as bauxite, diaspore, and kyanite; sources of silica, including sand and quartzite; magnesia minerals, magnesite, dolomite, forsterite, and olivine; chromite, a solid solution of chromic oxide with the oxides of aluminum, iron, and magnesium; carbon as graphite or coke; and vermiculite mica. Minor raw materials are zirconia, zircon, thoria, beryllia, titania, and ceria, and other minerals containing rare-earth elements. Other insulative materials may be implemented as appropriate. Each of the plurality of brick panels have slots, or retention grooves on opposite, first and second edges. The retention grooves may be formed into the plurality of brick panels as part of a molding process. The retention grooves accommodate the retention clips and/or retention edge of a base bracket.

The various components that make up the kit can be sized to work with multiple sizes of fireboxes such that, by using greater or fewer components, the kit can be used with any of a variety of differently sized fireboxes. In some examples, the brick installation kit is used to modify an open hearth (no glass) or closed hearth (glass) fireplace to have the appearance of a masonry fireplace, for example by supplying an interior façade to match an exterior brick surround. Any firebox or hearth may benefit from use of the brick kit, and the examples provided above should not be viewed as limiting.

As will be described in greater detail, in various implementations the brick installation kit does not require use of mortar or grout, and thus does not require the services of a brick mason or other trade specialist and is much faster than a traditional brick and mortar installation.

Some methods of installing the brick installation kit include the following steps. A base bracket is secured (e.g., using adhesive, self-tapping screws, fasteners, etc.) in place (e.g., to a back wall of a firebox) for installation of a first row of brick panels. A first row of the plurality of brick panels are seated on a retention edge of the base bracket. A first brick retention bracket is placed on top of the first row of brick panels and is secured in place (e.g., using adhesive, self-tapping screws, fasteners, etc.) A plurality of the retention clips (e.g., a strip or individual clips) is inserted through the retention apertures in the first brick retention bracket through the first brick retention bracket into the retention grooves of the first row of brick panels. A second row of brick panels is placed on top of first brick retention bracket with the tops of retention clips extending into the retention grooves of the second row of brick panels. A second brick retention bracket placed on top of second row of brick panels and a second retention clip strip (or individual clips) are inserted through the second brick retention bracket into retention grooves of the second row of brick panels. This process is repeated for the desired number of rows of brick panels.

The examples, advantages, features, components, and methods described above are meant to be illustrative, and not limiting in nature. Various additional and alternative aspects of the foregoing are contemplated.

The drawings and associated description are illustrative of various concepts addressed in this patent specification by way of example. The drawings are meant to be viewed by way of example, and are not to be viewed in a limiting manner.

DESCRIPTION

Figure 1:
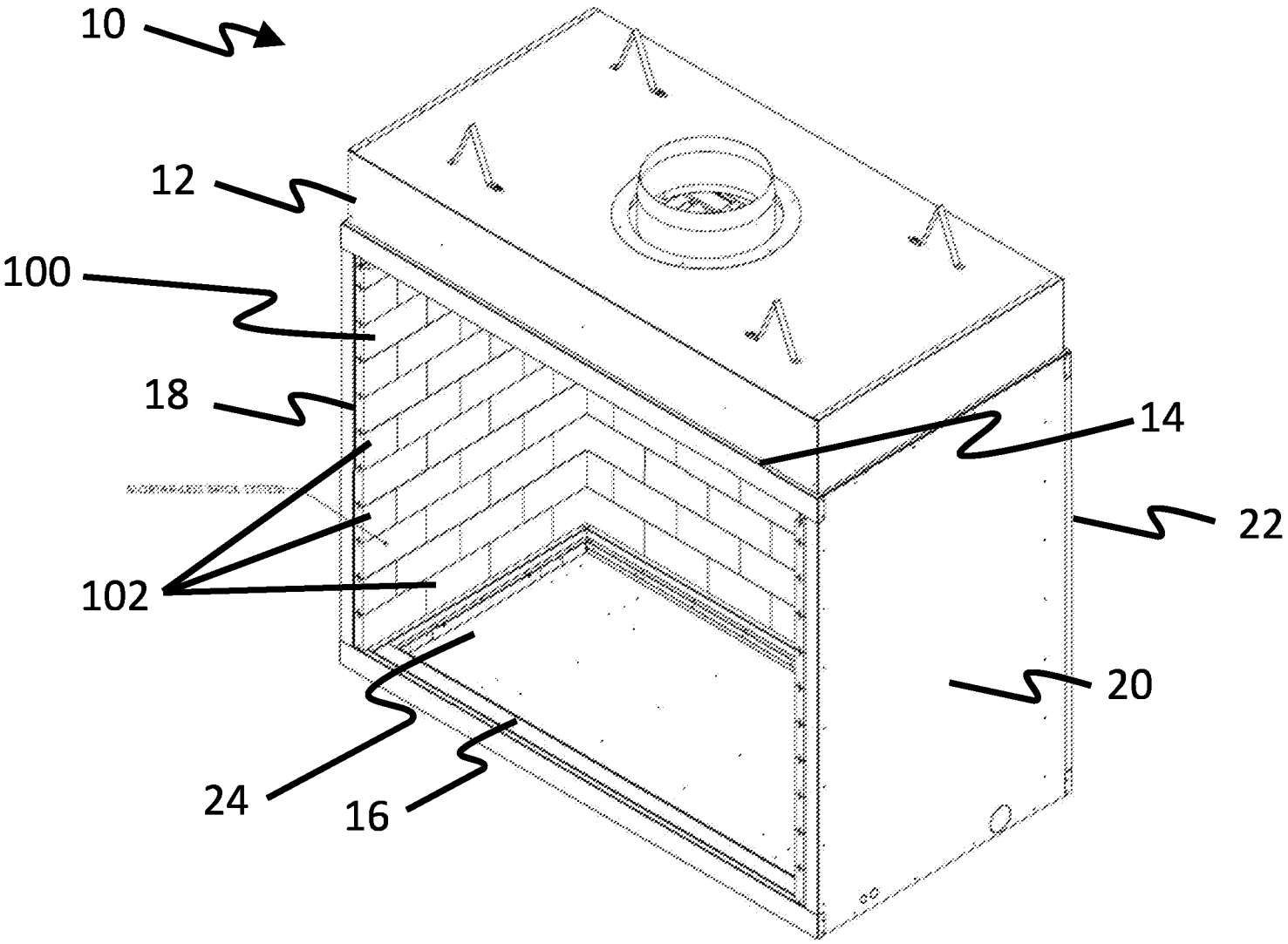
FIG. 1 is a perspective view of a fireplace assembly, according to some embodiments.

FIG. 1 shows a fireplace assembly 10, according to some embodiments. The fireplace assembly 10 includes a firebox 12 having a top 14 (FIG. 7), a bottom 16, a first side 18, a second side 20, a back 22, and an open front 24. The firebox 12 may be formed of heat resistant material, such as sheet metal. The firebox 12 is generally configured to house a heat source (not shown). The heat source may be an electric heat source or a gas heat source, for example. The gas heat source may include a gas burner (not shown) housed in the firebox 12. FIG. 1 also shows a brick installation kit 100 installed in the firebox 12, the brick installation kit 100 being configured to enhance at least the functional performance (e.g., heat resistance, insulative value, etc.) and/or aesthetic value (e.g., a more finished appearance, traditional fireplace appearance, matching appearance to a brick fireplace surround, etc.).

Figure 2:
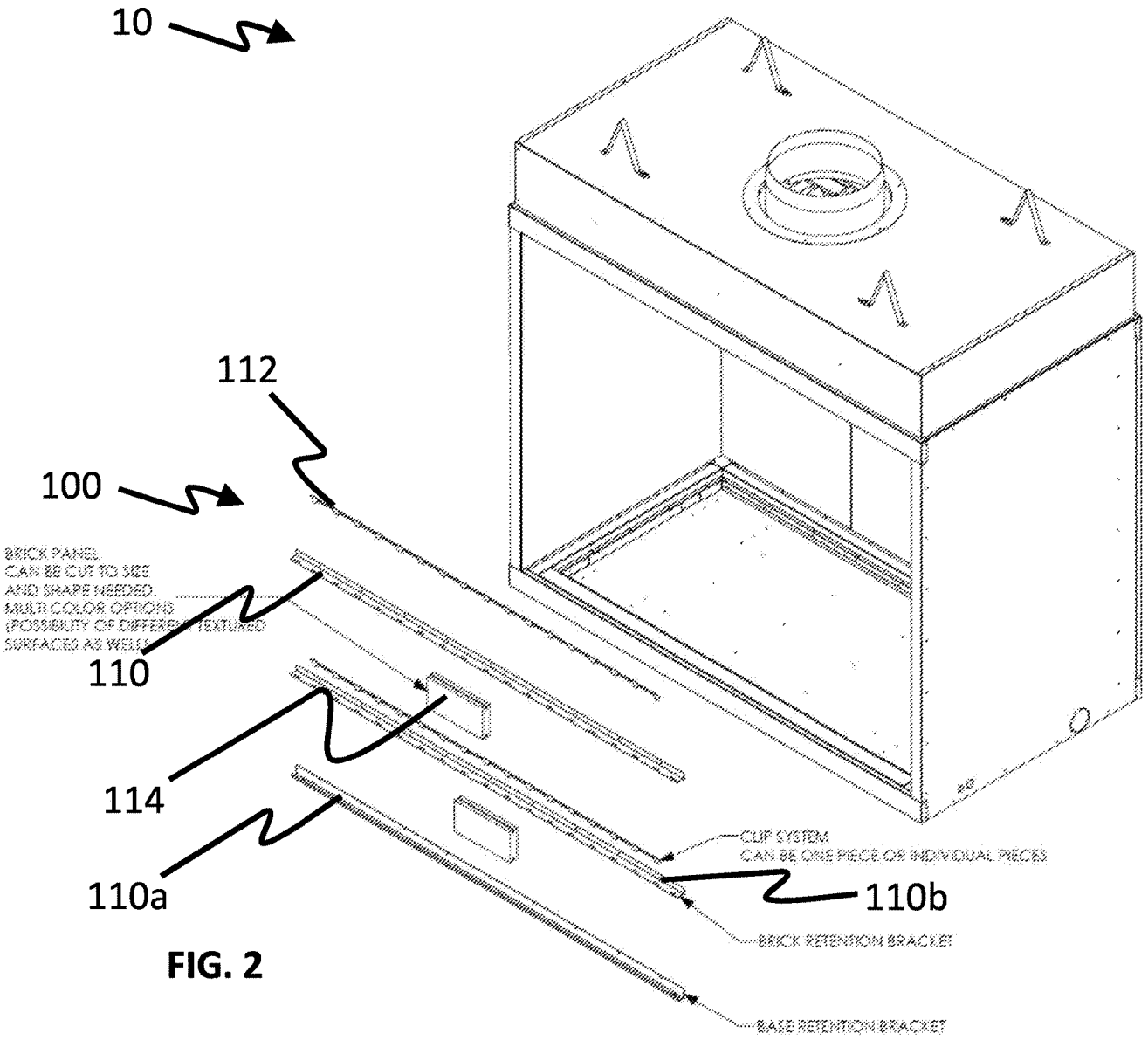
FIG. 2 is a perspective view of the fireplace assembly of FIG. 1 in a disassembled state, according to some embodiments.

FIG. 2 is a perspective view of the fireplace assembly 10 in a disassembled state, with components of the brick installation kit 100 shown separate and unsecured from the firebox 12. As shown in FIG. 1, the brick installation kit 100 includes a plurality of brick rows 102 installed on the first side 18, the second side 20, and the back 22 of the firebox 12. As shown in FIG. 2, components of the brick installation kit 100 include a plurality of retention brackets 110, a plurality of retention clips 112, and a plurality of brick panels 114. For ease of illustration, FIG. 2 does not show the full number of retention brackets 110, retention clips 112, and brick panels 114 that would be needed to cover the sides 18, 20 and back 22 of the firebox 12 as shown in FIG. 1.

Figure 3:
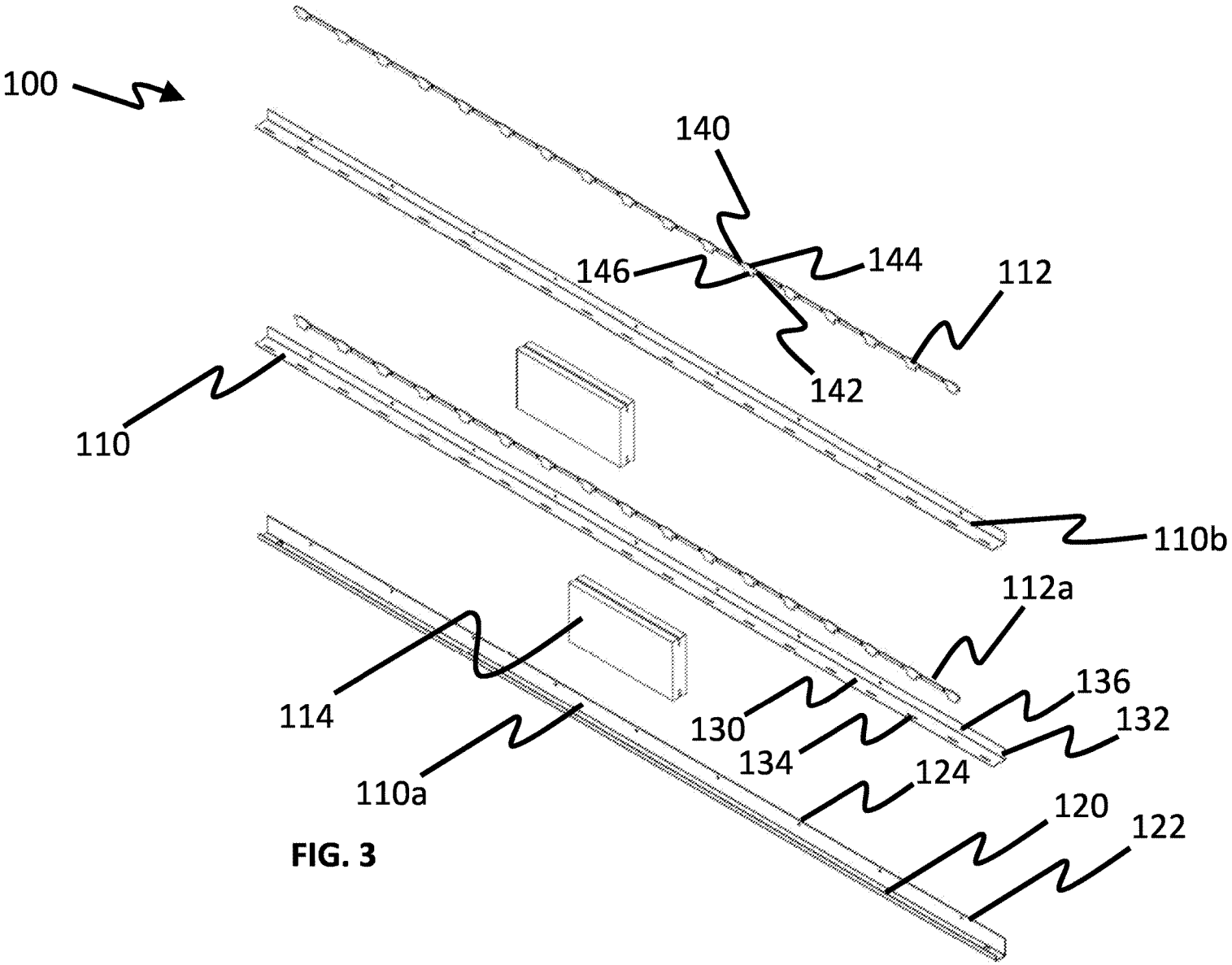
FIG. 3 is a perspective view of components of a brick installation kit of the fireplace assembly of FIG. 1 including installation clip strip(s), according to some embodiments.

FIG. 3 is an enlarged view of the components of the brick installation kit of FIG. 2 shown in greater detail. As shown, the plurality of retention brackets 110 optionally include a base retention bracket 110*a* and a plurality of intermediate retention brackets 110*b*. The base retention bracket 110*a* optionally includes a retention lip 120 and a coupling flange 122. The coupling flange 122 may have one or more coupling apertures 124 for securing the base retention bracket 110*a* to the walls of the firebox 12 (e.g., using fasteners, adhesives, welds, etc.). The intermediate retention brackets 110*b* optionally each include a clip flange 130 and a coupling flange 132. The clip flange 130 may have one or more clip apertures 134 and the coupling flange 132 may have one or more coupling apertures 136.

As shown in FIG. 3, the plurality retention clips 112 are coupled together into strip form, to define or form a plurality of clip strips 112*a*. As shown, each of the plurality of retention clips 112 includes a first ear 140, a second ear 142, a head 144 and a foot 146 (see also, FIG. 6). The plurality of retention clips 112 are interconnected at the ears 140, 142 by a strip of material, which may or may not be frangible to adjust the length of the clip strips 112*a*. The foot 146 of each retention clip 112 is configured to be inserted through one of the clip apertures 134 of the intermediate retention brackets 110*b*, with the ears 140, 142 acting as stops to prevent over insertion. In various examples, the heads 144 of the retention clips 112 are configured to act as a retention lip for the next stack, or row of brick panels 114

Figure 4:
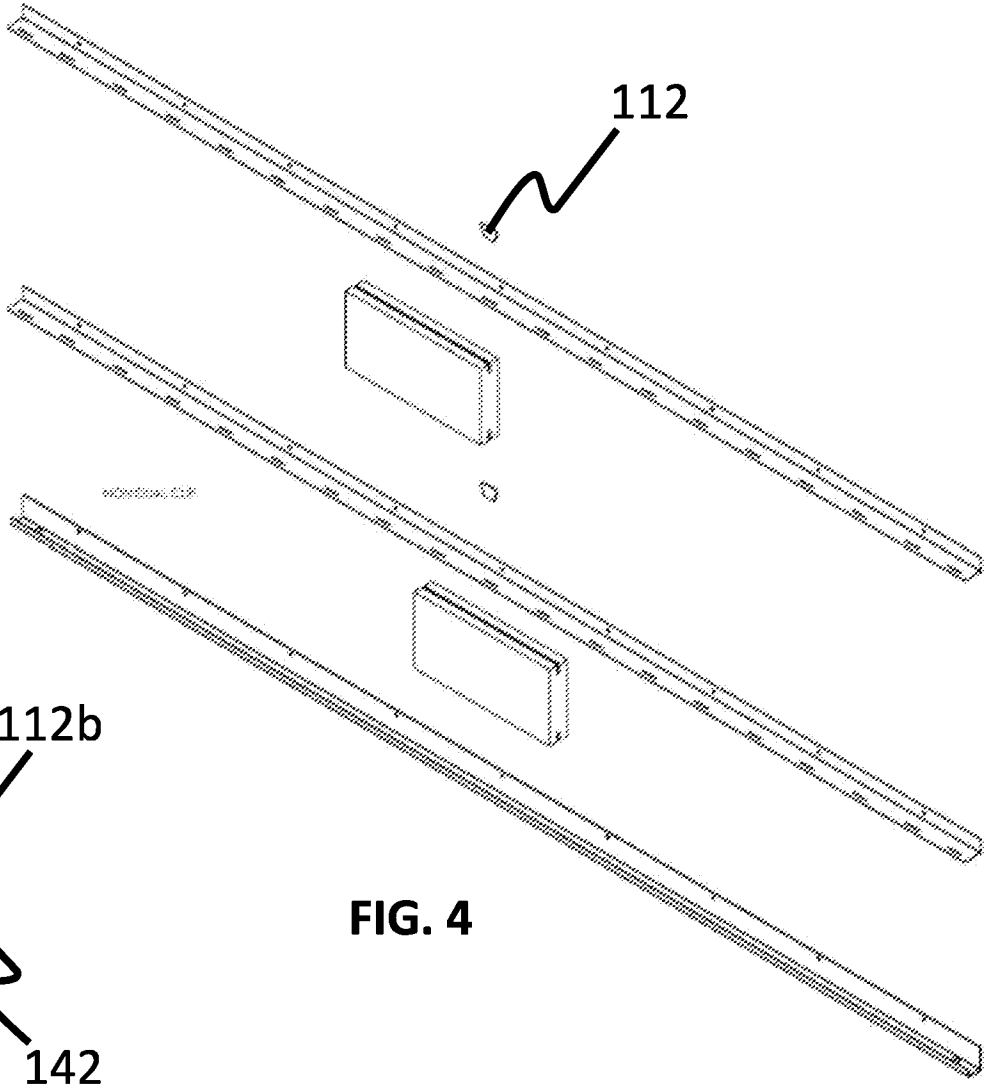
FIG. 4 is a perspective view of components of a brick installation kit of the fireplace assembly of FIG. 1 including separate installation clips, according to some embodiments.
Figure 5:
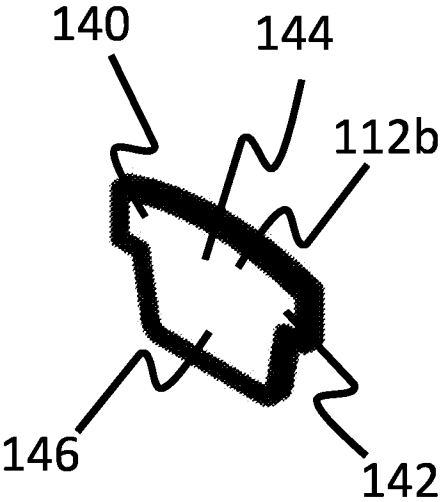
FIG. 5 is a perspective view of an installation clip of the brick installation kit of FIG. 4, according to some embodiments.

FIG. 4 is a perspective view of the components of the brick installation kit of FIG. 2, with the plurality of retention clips 112 provided as separate components, and not in strip form as shown in FIG. 3. FIG. 5 is an enlarged view of one of the pluralities of retention clips 112*b* separated out and not in strip form, or otherwise provided as a separate component. The first ear 140, second ear 142, head 144 and foot 146 are shown in the view of FIG. 4 as well and are optionally similarly configured to the retention clips 112 in strip form.

Figure 6:
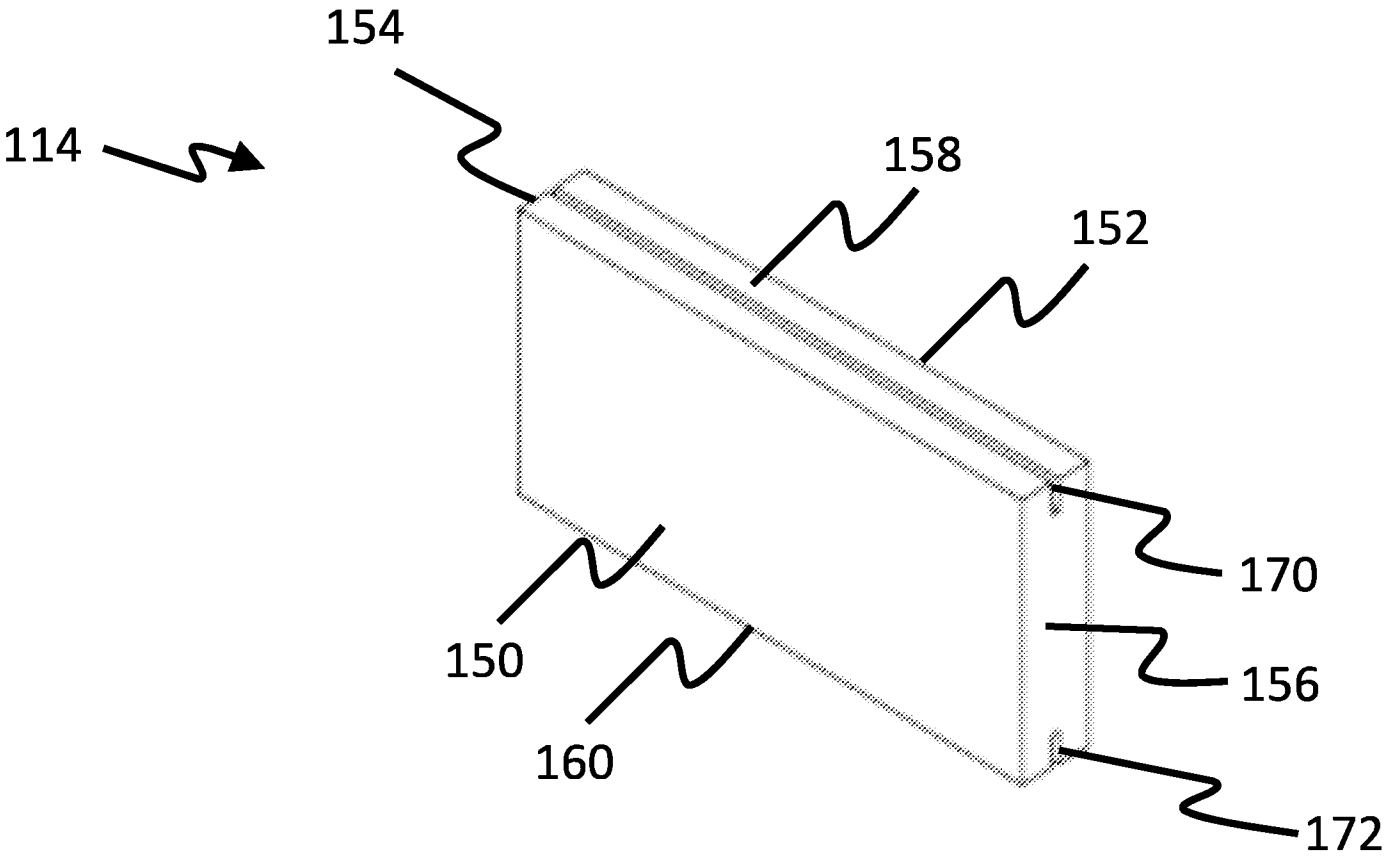
FIG. 6 is a perspective view of a brick panel of the brick installation kits of FIGS. 4 and 5, according to some embodiments.

FIG. 6 is an enlarged view of one of the pluralities of brick panels 114. As shown, each brick panel 114 optionally includes a front 150, a back 152, a first end 154, a second end 156, a first edge 158, and a second edge 160. As shown, the brick panel 114 is a generally planar-faced, rectangular piece. But that is not necessarily always the case, and the brick panel 114 may take on a variety of shapes, sizes, surface textures, materials, and other variations. As shown, the first edge 158 includes a first retention groove 170 and the second edge includes a second retention groove 172. The retention grooves 170, 172 run across a length of the first and second edges 158, 160, respectively.

Figure 8:
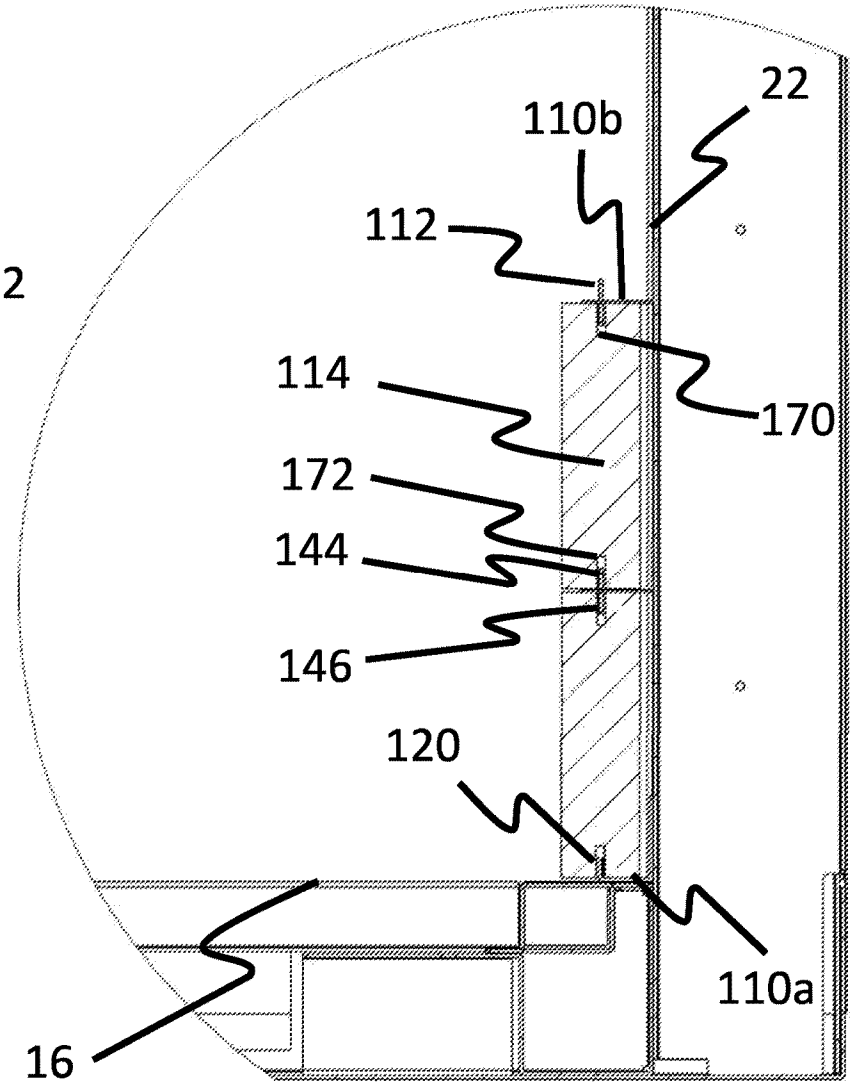
FIG. 8 is an enlarged view of a portion of the sectional view of FIG. 7, according to some embodiments.
Figure 7:
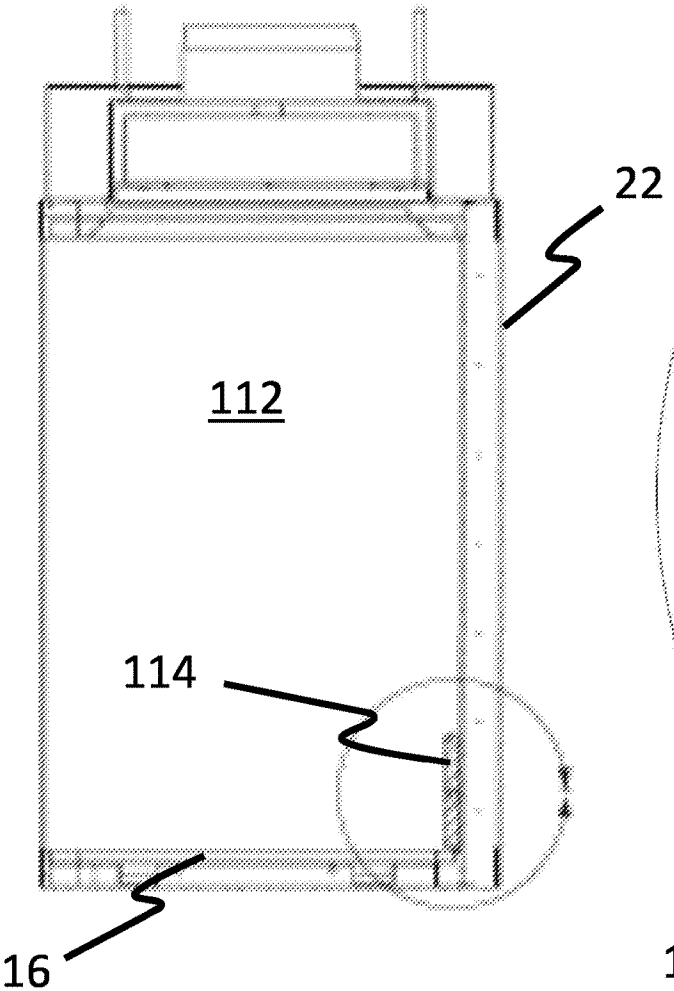
FIG. 7 is a sectional view taken along a lateral centerline of the fireplace assembly of FIG. 1, according to some embodiments.

FIG. 7 is a sectional view taken along a lateral centerline of the fireplace assembly of FIG. 1, and FIG. 8 is an enlarged view of a portion of the sectional view of FIG. 7 toward the bottom and back of the firebox 12, according to some embodiments. As shown, the base retention bracket 110*a* is installed at the bottom 16 with the retention lip 120 received in a first row of brick panels 114, and more specifically in the second retention grooves 172 of the brick panels 114. The coupling flange 122 is coupled (e.g., using one or more mechanisms previously described) to the back 22. As shown in FIG. 1, the first row of brick panels 114, and each of the rows 102 is assembled with the brick panels 114 arranged end-to-end. A first one of the intermediate retention brackets 110*b* is installed next to the first row of brick panels 114, with the coupling flange 136 secured to the back 22 and the clip flange 130 proximate to, or abutted against the first edges 158 of the first row of brick panels 114. A plurality of the retention clips 112 (e.g., in strip, or singular form) are inserted through the clip apertures 134 in the first one of the intermediate retention brackets 110*b* such that the feet 146 are received in the first retention grooves 170 of the first row of brick panels 114. In this manner the first row of brick panels 114 are secured to the firebox 12.

A second row of brick panels 114 are then assembled against the clip flange 130 of the first intermediate retention bracket 110*b* with the heads 144 of the of the retention clips 112 received in the second retention grooves 172 of the second row of brick panels 114. A second one of the intermediate retention brackets 110*b* is then installed with its clip flange 130 proximate to or abutted against the first edges 158 of the second row of brick panels 114, with its coupling flange 136 secured to the back 22 of the firebox 12. This process continues for the desired number of rows of brick panels 114 to be installed. And, a similar process is carried out for the sides 18, 20 of the firebox 12 as desired. In some examples, the final, or terminal row of brick panels is finished using a second base retention bracket 110*a* rotated 180 degrees with the retention lip 120 of the second base retention bracket received in the first retention grooves 170 of the brick panels 114 of the final row of brick panels 114. In various examples, the system does not require the use of grout, adhesive, or other secondary fixation means to attach the rows 102 (FIG. 1).

Figure 9:
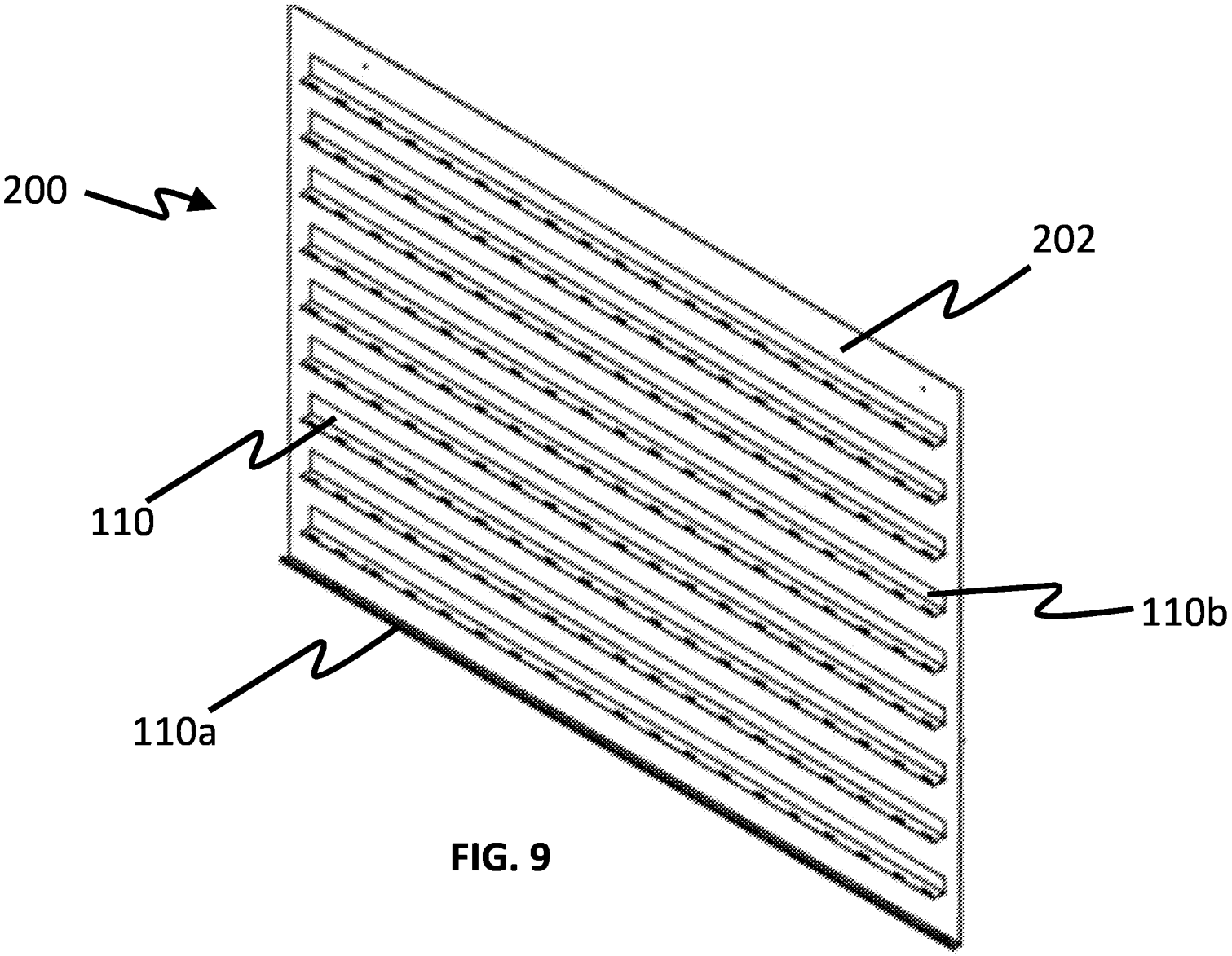
FIG. 9 is an enlarged view of a retention bracket panel, according to some embodiments.

FIG. 9 shows another configuration for the plurality of retention brackets 110. In particular, as shown in FIG. 9, the plurality of retention brackets 110 are optionally supplied as part of a retention bracket panel 200, including a support panel 210 and the plurality of retention brackets 110 coupled to the support panel 210. In general terms, the retention brackets 110 operate similarly to those previously described, including the base and intermediate retention brackets 110*a*, 110*b*.

In some examples, one or more of the plurality of retention brackets 110 are separate components that are coupled (using fasteners, welds, adhesives, or other means) to the support panel 210. In some embodiments, one or more of the plurality of retention brackets 100 are integrally formed with the support panel 210 (e.g., cast, punched, pressed, bent, or otherwise formed as part of the support panel 210). In various examples, the retention bracket panels are configured to be installed in a firebox of a fireplace and secured thereto (e.g., using fasteners, adhesives, or the like). For example, the support panel 210 may be sized and shaped to fit into the back and/or side(s) of the firebox 12 (FIG. 1) and secured thereto (e.g., secured to the back 22 of the firebox 12, first side 18 and/or second side 20). In different terms, the retention bracket panel(s) 200 may generally configured to cover the back 22 and/or the sides 18, 20 of the firebox 12. In still other embodiments, the retention bracket panel(s) 200 replace, or define, the firebox back and/or sides.

In terms of use, the plurality of retention brackets 110 of the retention bracket panel(s) 200 operate similarly with the plurality of retention clips 112 and the plurality of brick panels 114 as shown in FIG. 1. In some examples, the plurality of brick panels 114 are slid and cammed/angled into the gap(s) between adjacent ones of the plurality of retention brackets 110 to secure the retention grooves in corresponding retention clips 112 and/or retention edge(s). Again, for ease of illustration, the full number of retention bracket panels 200, retention clips 112 and brick panels 114 that would be needed to cover the sides 18, 20 and back 22 of the firebox 12 are not shown, but should be clearly understood with reference to FIG. 1.

The foregoing description provides examples of the various concepts, advantages, features, and implementations of the designs addressed in this patent specification. The description is meant to be illustrative, and not limiting in nature, and the invention(s) to be addressed in this specification, or any related application, are defined by the claims of that specific application, including any equivalents thereof.

We claim the following:

1. A brick installation kit configured to be installed in a firebox, the brick installation kit comprising:

a plurality of retention brackets, including a first retention bracket including a plurality retention slots, a plurality of retention clips, each retention clip having a head and a foot receivable in a corresponding one of the plurality of retention slots, and a plurality of brick panels, each brick panel having a first edge, a second edge opposite the first edge a first retention groove running along the first edge and a second retention groove running along the second edge, the first retention groove configured to receive the foot of a corresponding one of the plurality of retention clips and the second retention groove configured to receive a head of a corresponding one of the plurality of retention clips.

2. The brick installation kit of claim 1, wherein the retention brackets are installed in the firebox and secured thereto.

3. The brick installation kit of claim 2, wherein the firebox is defined by a back, a first side, and a second side, and further wherein the plurality of retention brackets run laterally across at least one of the back, the first side, and the second side of the firebox.

4. The brick installation kit of claim 2, wherein the firebox forms part of a fireplace.

5. The brick installation kit of claim 4, wherein the fireplace is a gas fireplace.

6. The brick installation kit of claim 1, wherein the plurality of retention brackets include one or more starter brackets, each starter bracket defining a retention edge configured to be received in at least one of the first and second retention grooves of one or more of the plurality of brick panels.

7. The brick installation kit of claim 1, wherein the plurality of retention brackets are associated with a support panel.

8. The brick installation kit of claim 7, wherein the support panel is coupled to a wall of a firebox.

9. The brick installation kit of claim 7, wherein the support panel defines a wall of a firebox.

10. The brick installation kit of claim 1, wherein the plurality of retention clips are separate, individual components.

11. The brick installation kit of claim 1, wherein the plurality of retention clips are formed as part of a plurality of clip strips, each clip strip including a plurality of retention clips.

12. The brick installation kit of claim 1, wherein the plurality of brick panels are made of insulative material.

13. The brick installation kit of claim 12, wherein the plurality of brick panels are each formed of firebrick, refractory brick material, or a combinations thereof.

14. The brick installation kit of claim 12, wherein the plurality of brick panels are formed of raw material including cements, fiber reinforced cements; fireclays, such as hydrated aluminum silicates; minerals of high aluminum oxide content, such as bauxite, diaspore, and kyanite; sources of silica, including sand and quartzite; magnesia minerals, magnesite, dolomite, forsterite, and olivine; chromite, a solid solution of chromic oxide with the oxides of aluminum, iron, and magnesium; carbon as graphite or coke; and vermiculite mica.

15. A method of installation a brick installation kit, the method comprising:

coupling a base bracket within a firebox;

seating a first row of a plurality of brick panels on a retention edge of the base bracket, a first brick retention bracket being positioned on top of the first row of brick panels; and inserting a plurality of retention clips through retention apertures in the first brick retention bracket, through the first brick retention bracket, and into retention grooves of the first row of brick panels.

* * * * *